US010160023B2

(12) United States Patent
Schoellhammer et al.

(10) Patent No.: US 10,160,023 B2
(45) Date of Patent: Dec. 25, 2018

(54) DRAWING PRESS WITH STABLE METAL SHEET HOLDER

(71) Applicants: Dietmar Schoellhammer, Goeppingen (DE); Martin Schmeink, Salach (DE); Andreas Dangelmayr, Ottenbach (DE); Hans Hofele, Zell U. A. (DE); Juergen Fahrenbach, Aichelberg (DE)

(72) Inventors: Dietmar Schoellhammer, Goeppingen (DE); Martin Schmeink, Salach (DE); Andreas Dangelmayr, Ottenbach (DE); Hans Hofele, Zell U. A. (DE); Juergen Fahrenbach, Aichelberg (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 668 days.

(21) Appl. No.: 13/765,731

(22) Filed: Feb. 13, 2013

(65) Prior Publication Data

US 2013/0180301 A1 Jul. 18, 2013
US 2018/0264536 A9 Sep. 20, 2018

Related U.S. Application Data

(63) Continuation-in-part of application No. PCT/EP2011/064043, filed on Aug. 15, 2011.

(30) Foreign Application Priority Data

Aug. 16, 2010 (DE) ..... 10 2010 034 518
Oct. 4, 2010 (DE) ..... 10 2010 037 950

(51) Int. Cl.
*B21D 24/04* (2006.01)
*B21D 24/00* (2006.01)
(Continued)

(52) U.S. Cl.
CPC ..... *B21D 24/04* (2013.01); *B21D 24/00* (2013.01); *B21D 53/88* (2013.01); *B30B 1/14* (2013.01);
(Continued)

(58) Field of Classification Search
CPC ..... B21D 22/02; B21D 22/20; B21D 22/22; B21D 24/04; B21D 24/08; B21D 24/10; B21D 24/14; B21D 24/06; B21D 24/12
(Continued)

(56) References Cited

U.S. PATENT DOCUMENTS

2006/0156933 A1* 7/2006 Hofele et al. ..... 100/281
2009/0090161 A1* 4/2009 Amino ..... B21D 22/22 72/453.12
2011/0290126 A1* 12/2011 Ito et al. ..... 100/280

FOREIGN PATENT DOCUMENTS

DE 195 11 379 A1 10/1996
DE 101 17 578 B4 9/2007
(Continued)

OTHER PUBLICATIONS

English translation of DE 19511379.*

*Primary Examiner* — Debra Sullivan
(74) *Attorney, Agent, or Firm* — R. S. Lombard

(57) ABSTRACT

The drawing press according to the invention includes a support structure for supporting a metal sheet holder which is part of a tool and supported on the press frame via the support structure. The metal sheet holder is assigned a plunger with a die tool, whereas the plunger is moved by means of a plunger drive which includes a blocking position. The blocking position is obtained, for example, by a drive which, in the blocking position does not transmit any movement of the drive output to the driving servomotor. This can be achieved, for example, by an eccentric drive in the stretched position thereof. For performing the actual
(Continued)

drawing stroke, the stamping tool is vertically movably supported. A carriage is raised or lowered by the press table by means of a table drive. As table drive, preferably a servomotor with a non-linear drive, such as an eccentric drive is used.

17 Claims, 7 Drawing Sheets

(51) Int. Cl.

| | |
|---|---|
| ***B30B 1/14*** | (2006.01) |
| ***B30B 1/18*** | (2006.01) |
| ***B30B 1/26*** | (2006.01) |
| ***B30B 1/28*** | (2006.01) |
| ***B21D 53/88*** | (2006.01) |

(52) U.S. Cl.
CPC ..... *B30B 1/18* (2013.01); *B30B 1/266* (2013.01); *B30B 1/28* (2013.01)

(58) Field of Classification Search
USPC ..... 72/452.5, 454, 350; 100/280, 281, 282, 100/283, 286
See application file for complete search history.

(56) References Cited

FOREIGN PATENT DOCUMENTS

| | | | |
|---|---|---|---|
| DE | 10 2006 025271 | B3 | 12/2007 |
| GB | 388 566 | A | 3/1933 |
| GB | 512 631 | A | 9/1939 |
| WO | WO 9958265 | A1 * | 11/1999 |

* cited by examiner

DRAWING PRESS WITH STABLE METAL SHEET HOLDER

CROSS-REFERENCE TO RELATED APPLICATION

This is a continuation-in-part application of pending international application PCT/EP2011/064043 filed Aug. 15, 2011 and claiming the priority of German Application No. 10 2010 034 518.0 filed Aug. 16, 2010 and the priority of German Application No. 10 2010 037 950.6-14 filed Oct. 4, 2010.

BACKGROUND OF THE INVENTION

The invention resides in a drawing press which is suitable in particular for integration into press working lines, hybrid press set ups or transfer presses for the manufacture automobile body parts.

In the manufacture of automobile body parts or other large area spatially formed metal sheets the first press stage is generally a drawing press which gives an initially planar plate a spatial shape. This is done in a drawing press in which the rim of the metal sheet is clamped in position or which permits the rim to slide toward the plate center in a controlled manner, while the part of metal sheet surrounded by the sheet holder is compressed between a die and a plunger to deform it spatially as desired. For this purpose, drawing presses have been developed wherein the plunger is supported on a press table and the respective die is disposed on the vertically up and down movable stamping tool. The sheet holder surrounds the plunger and is pressed downwardly during the drawing procedure by the rim of the die against the force of a draw cushion. With this basic configuration, the convexly arched sheet side is formed at the top of the sheet part as it is desirable for the follow-up press steps. In the subsequent pressing steps also punching procedures are performed for which, in connection with vehicle body parts, the punching lever must be at the concavely curved side of the metal sheet part. Since turn-over stations between the pressing steps are to be avoided the manufacturing procedure as described herein has become the standard procedure. Manufacturing procedures with bottom dies and top plungers (as well as upper metal sheet down holders) as they are known, for example, from DE 10117578 B4 are rarely used.

Presses of the type as described above, that is with upper dies and lower plunger are known, for example, from DE 10 2006 025271 B3. Since it has been recognized that with this concept at the drawing cushion a large amount of energy is used and generally lost which energy has to be provided by the plunger. Because the plunger has to hold the metal sheet holder down during the drawing procedure the above publication proposed the recuperation of the work or respectively energy expended on the drawing cushion by applying the metal sheet down holding force by means of servomotors and low-friction spindle screw drives. The energy can be retrieved by the servomotors from the drawing cushions during a generator operation of the motors and returned to the power supply.

However, during the energy recuperation energy losses are unavoidable.

It is therefore the object of the present invention to provide a press concept and a conversion process wherein by an orientation of the subsequent press stages, deep draw components can be manufactured with low energy consumption.

SUMMARY OF THE INVENTION

The drawing press 10 according to the invention includes a support structure 47 for supporting a metal sheet holder 35 which is part of a tool and supported on the press frame 11 via the support structure 47. The metal sheet holder 35 is assigned a plunger 15 with a die tool 18, whereas the plunger 15 is moved by means of a plunger drive which includes a blocking position. The blocking position is obtained, for example, by a drive 22 which, in the blocking position does not transmit any movement of the drive output to the driving servomotor 23 and/or 24. This can be achieved, for example, by an eccentric drive 25, 26 in the stretched position thereof. For performing the actual drawing stroke, the stamping tool 34 is vertically movably supported. A carriage 32 is raised or lowered by the press table 31 by means of a table drive 36. As table drive 36, preferably a servomotor with a non-linear drive, such as an eccentric drive is used.

In accordance with the present invention, the drawing press comprises a plunger for accommodating a die tool and a driven table for accommodating a plunger tool. The plunger and the table are movable toward and away from one another in a controlled manner. In other words, the drawing press includes two machine elements that is the plunger and the press table which are movable relative to one another along a line for performing the drawing procedure. During this procedure, the plunger only opens and closes the tool and clamps the rim of the work piece. The pulling stroke is performed by the press table by moving the press table with the die while the plunger and the metal sheet holder are stationary.

The plunger drive preferably includes a blocking position in which forces effective on the plunger are introduced into the press frame completely or at least mostly by-passing the actual press drive such as, for example, a servo-motor. Such a blocking position is provided, for example, by an eccentric drive, an elbow lever drive or a similar drive in the respective stretched position. With an eccentric drive, the stretched position is the position in which the lever arm of the eccentric (the connecting line between the center of rotation of the eccentric and the center point of the eccentric) is aligned with the respective crank arm.

The table drive provides for the respective deformation stroke, which is required for deforming the metal sheet, preferably while the plunger drive is in a blocked position or another rest position. The die is in a rest position during the drawing procedure while it provides in particular the metal sheet holding force for its engagement with the metal sheet holder which is also resting. The metal sheet holding force is consequently initiated preferably by the plunger and the die supported thereby as well as by the metal sheet holder and is taken up by the press frame. It does not need to be provided by the press or by deformation drives.

This substantially reduces the power required for driving the plunger and for driving the table. The power required just for moving the plunger is small. In addition to the energy required for the dynamic acceleration and deceleration of the plunger and the die before the begin of a drawing stroke, when the die tool has come into contact with the metal sheet, only the build up of the holding force is necessary which is then maintained stable via the press frame. Alternatively, the metal sheet retaining force may also be provided by a short-stroke metal sheet holder drive. Also, the metal sheet holder drive may have a blocking position. It may, for example, be in the form of a short stroke eccentric drive or a cam drive which clamps the metal sheet holder into engagement with the die tool and which transmits the clamping forces directly into the press frame. In this case, a blocking position is reached when the eccentric drive is in the stretched position or, in connection with a cam drive; the cam is engaged at the maximum radius area thereof. The movement of the servomotor driving the die results in no or only a negligible metal sheet holder movement.

The table drive, on the other hand, needs to supply only the deformation energy for forming the metal sheet.

The press concept presented herewith minimizes the energy required for the plunger drive and for the table drive and also the power exchange between the two drives. The press, according to the invention, requires therefore in comparison with presses which have an intensive energy exchange between the plunger drive and the drawing cushion, small drives for the same capacity.

In addition with the described press concept the manually required over-all stroke of, for example, 1300 mm is divided into two strokes that is the stroke of the plunger and the stroke of the table. Whereas the stroke of the plunger is more by provided for the opening and the closing of the tool, the stroke of the table is provided for the displacement of the die that is for performing the actual drawing process. The plunger stroke may be, for example, only 1000 mm and the table stroke may, for example, be only 300 or 400 mm. Also, for this reason the plunger drive may be smaller than a conventional drive.

The press concept presented herewith permits the continued use of existing tool sets which had been provided for operation with a stationary die and a metal sheet holder that is moved downwardly during the drawing procedure. Also, the conventional transfer arrangements may be used without essential adaptation changes. With the drawing press according to the invention the linearly movable table may have a group of passages through which support elements extend. These support elements, for example, in the forms of straight bolts, extend through these passages and support the metal sheet holder at a support area. The support area is preferably arranged fixed with respect to the press frame. This means that the position of the metal sheet holder with respect to the press frame is firmly fixed or fixed by an adjustment arrangement. When the metal sheet disposed on the metal sheet holder is biased by the die against the metal sheet holder and plunger drive is in a blocking position (that is for example the drive has reached its stretched position), the metal sheet retaining force is determined by the elasticity of the press frame. This elasticity may be in the range of a few millimeters to a few 10 millimeters. The energy elastically stored in the press frame can be returned to the plunger drive during the return stroke of the plunger which further reduces the overall energy consumption of the drawing press.

It is also possible to provide for the support area of the support elements some resiliency, for example, in the form of spring packets. It is also possible to provide the support area with an adjustment drive which may be of hydraulic or mechanical nature. Such as adjustment drive may be, for example, a short stroke elbow lever drive or an eccentric drive as referred to earlier or a similar drive. The adjustment stroke is typically at most 10 mm. This concept is especially advantageous if the plunger drive can be moved to its blocking position only with a small force and can be arrested in this position. In this case, the metal sheet retaining force can be applied after the blocking of the plunger by the short stroke metal sheet holder drive. The adjustment stroke of the metal sheet holder drive is then preferably at least as large as the overall resiliency of the press frame.

The plunger drive as well as the table drive are preferably independent servomotor drives. The servomotors act on the plunger or, respectively, the table preferably via drives which have at least one rest position. A rest position is a position in which the movement reduction ratio is very large or even infinite. This is the case of an eccentric drive as well as an elbow lever drive when the drive elements are in a stretched position. Multi-member drives with several stretched positions may be used advantageously also.

Preferably the servomotor of the plunger drive is operated reversibly. It stops near the lower plunger dead center position and in this way moves the eccentric and its connecting rod in a stretched position. In order to move the plunger upon completion of the deformation of the metal sheet again from the lower dead center position in the opposite direction for opening the tool, the servomotor may be energized to rotate in the opposite direction until the plunger has executed the desired opening stroke. The angle by which the eccentric is turned may be limited to a value <180° or preferably <90°. The same applied to the table drive wherein the angle may be limited to <60°.

BRIEF DESCRIPTION OF THE DRAWINGS

Further particulars of advantageous embodiments of the invention will become apparent from the claims, the drawings or the description. It is shown in:

DETAILED DESCRIPTION OF THE PARTICULAR EMBODIMENTS

Figure 1:
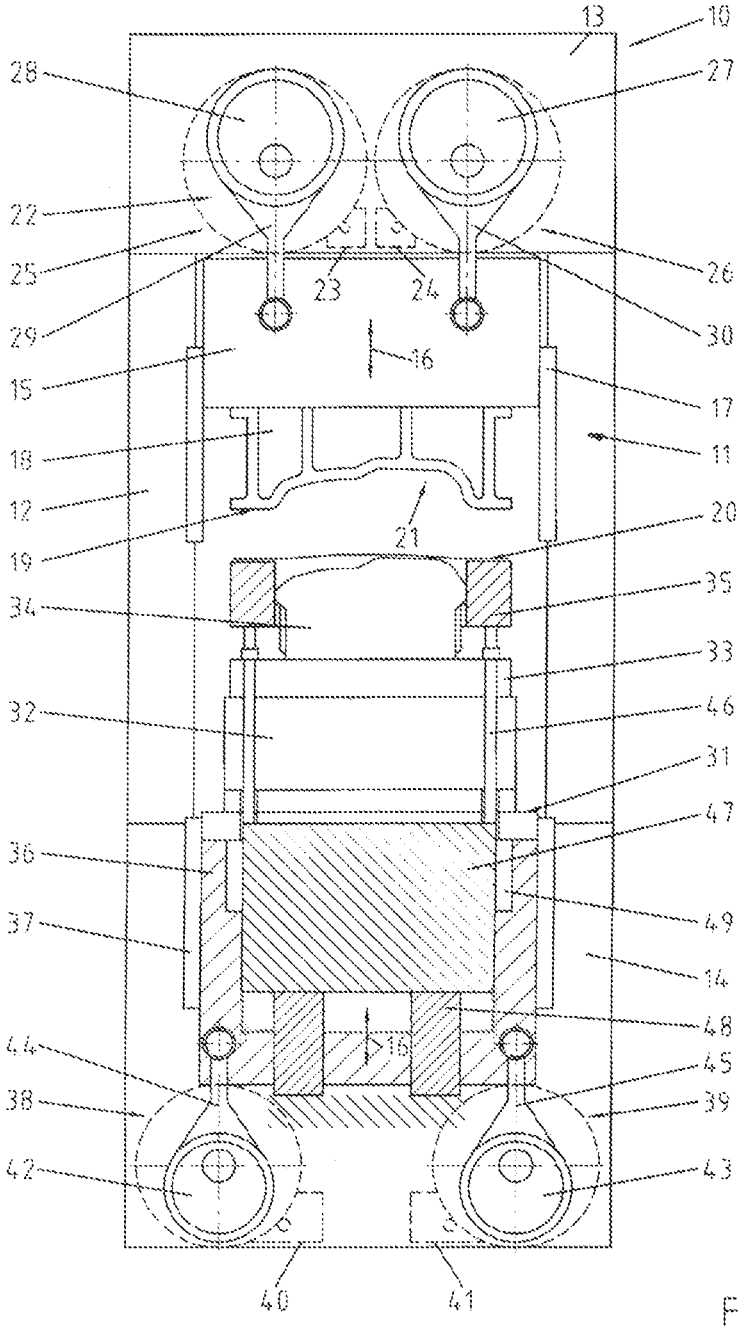
FIG. 1 a drawing press according to the invention in a schematic representation with the tool in an open position.

FIG. 1 shows a drawing press 10 for the manufacture of large metal sheet parts such as vehicle body parts. The drawing press 10 includes a press frame 11 which comprises at least one, preferably several, preferably vertically oriented posts 12, a head 13 which is supported by the parts 12, and a base 14 which is arranged below or between the posts 12. The head 13, the posts 12 and the base 14 form a closed frame. Within this frame a plunger 15 is supported so as to be movable, for example, in a vertical direction 16. For supporting the plunger 15, the posts 12 are provided, for example, with linear guide structures 17.

The plunger 15 is designed for the accommodation of an upper tool part in the form of a die tool 18. It is shown in FIG. 1 in cross-section and has a rim 19 for clamping and retaining the rim of a workpiece during the drawing procedure. The workpiece is an originally flat metal sheet 20. The rim 19 surrounds a hollow space 21 of the tool into which the workpiece is deformed.

For driving the plunger 15, a plunger drive 22 is provided which comprises one or several servomotors 23, 24 which are connected to the plunger 15 via one or several drives 25, 26. The two drives 25, 26 are in the shown exemplary embodiment mirror-reversed with respect to each other, each in the form of an eccentric drive. They each comprise an eccentric 27, 28 which is connected to the plunger 15 via a connecting rod 29, 30.

Furthermore, the drawing press 10 includes a press table 31 on which a carriage 32 may be supported. The carriage 32 facilitates the exchange of tools in a well known manner. The carriage 32 supports the lower tool part which includes a tool support 33 with a stamping tool 34 and a metal sheet holder 35 disposed thereon. The stamping tool 34 is a convex die whose upper contour corresponds to the hollow space 31. It is surrounded by the metal sheet holder 35 which, in most cases, is of rectangular shape, wherein the metal sheet holder and the stamping tool 34 are movable relative to each other in the direction of movement 16.

The unit consisting of the stamping tool 34, the tool support 33, the carriage 32 and the press table 31 is based on a table drive 36 which is movable in the direction of movement 16 (see the corresponding arrow) toward, and away from, the plunger 15. The press table 31 or, respectively, its table drive 36 is movable in the press frame linearly in the direction of movement along the posts 12 and/or the base 14 by means of guide arrangements 37. The table drive 36 includes one or several drives 38, 39 which each one provided with a blocking arrangement like the drives 25, 26. They are, for example, in the form of eccentric drives which provide for a drive connection between the press table 31 and one or several servomotors. The drives 38, 39 comprise each an eccentric 42, 43 which is connected to the press table by a connecting rod 44, 45.

The metal sheet holder 35 is supported on a support structure 47 by suitable support elements, for example, in the form of support bolts 46. The support structure 47 may be arranged fixed with respect to the base 14. Alternatively, it may be associated with an adjustment apparatus 48 which can adjust the position of the support structure 47 with respect to the direction of movement 16. This occurs normally when it is not under load. The adjustment apparatus 48, however, may be so designed that it can adjust the support structure under load, for example, in order to influence or control the force effective on the metal sheet holder and the retaining rim of the workpiece. The adjustment apparatus 48 can be in the form of hydraulic cylinders, elbow lever adjustment devices, spindle stroke adjustment drives or similar. Between the support structure 47 and the table drive 36 linear guide arrangements 49 which are oriented in the direction of movement 16 may be provided.

The drawing press 10 as described above operates as follows:

First, the drawing press is in an open position. In this position the plunger 15 is moved to an upper position by a corresponding rotation of the eccentrics 27, 28. The press table is moved to a lower position by a corresponding rotation of the eccentrics 42, 43. As a result, the stamping tool 34 projects somewhat over the metal sheet holder 35. An essentially planar metal sheet can now be placed onto the metal sheet holder 35.

Figure 2:
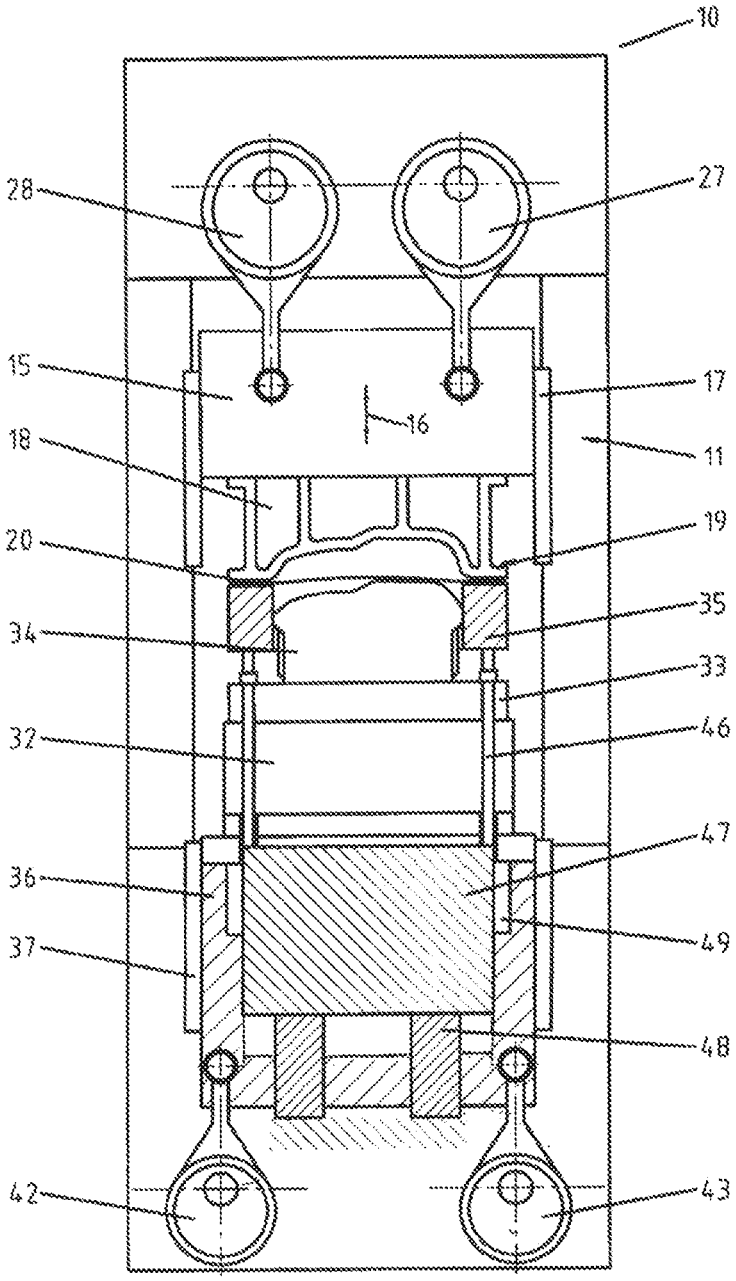
FIG. 2 the press according to FIG. 1 at the beginning of a drawing procedure.

As soon as workpiece transport means such as feeders, suction holders or other grippers, not shown in the drawings, are moved out of the work space, the tool can be closed. To this end, the drawing press 10 is brought into the position as shown in FIG. 2. The servomotors 23, 24 not shown in FIG. 2, have by then rotated the eccentrics 27, 28 so far that the plunger 15 has reached its lower dead end position. Shortly before reaching that position, the rim 19 of the die tool 18 is seated on the metal sheet 20 and begins to press the metal sheet rim against the metal sheet holder 35. The metal sheet holder 35 rests via the support elements 46 firmly on the support structure 47, so that, now, the press frame is stressed in the direction of movement 16. The frame elasticity constant determines in connection with the set position of the metal sheet holder 35 the clamping force effective on the rim of the metal sheet in a precise manner. When the lower position of the plunger, that is the clamping position of the die tool 18 has been reached, the servomotors 23, 24 are completely or at least almost completely load-free. The metal sheet engagement force is provided by the connecting rod-eccentrics arrangement of the drive 25, 26 being supported in a stretched position on the head 13. For maintaining the engagement force effective on the rim of the metal sheet 20, no energy is consumed. And no energy exchange between the plunger drive and any drawing cushion is needed.

Figure 3:
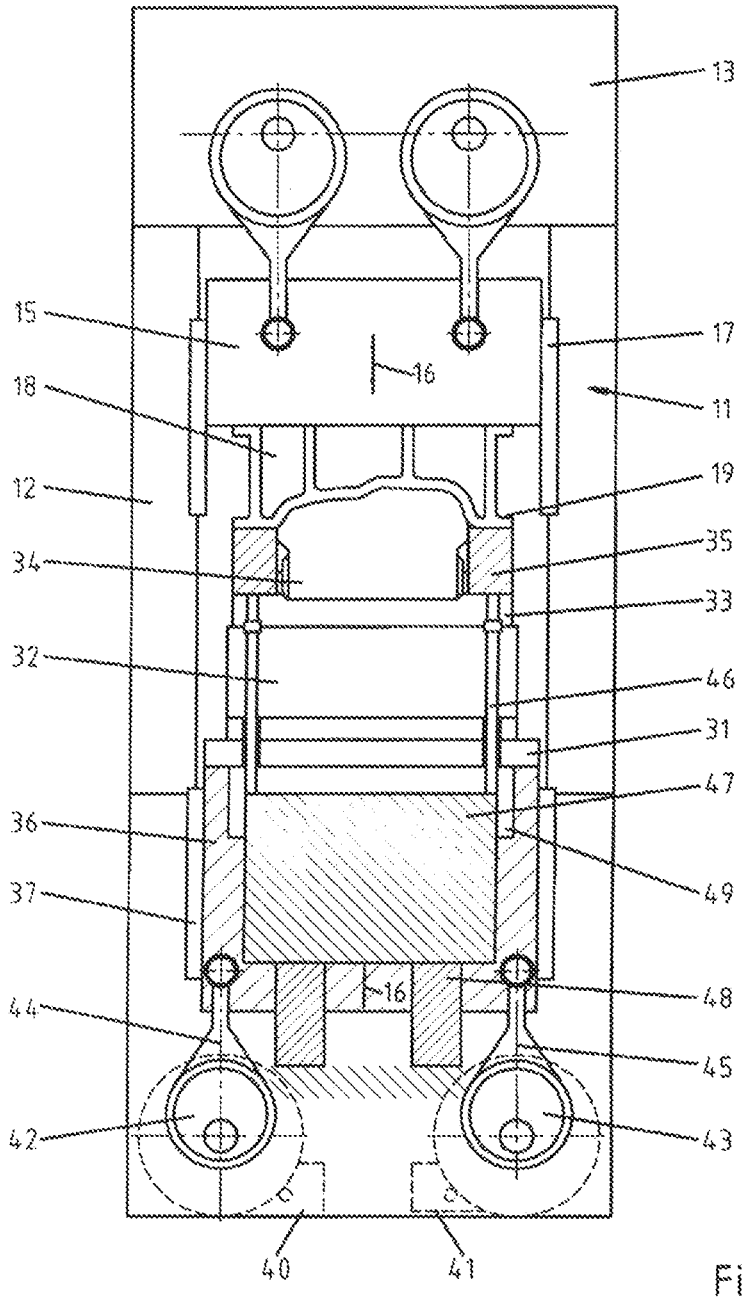
FIG. 3 the press according to FIG. 1 at the completion of a drawing procedure.

Based on this state now, the actual drawing procedure is performed whose end is shown in FIG. 3. For performing the drawing procedure, the servomotors 40, 41 are energized for moving the eccentrics 42, 43 with the connecting rods 44, 45 into a stretched position and consequently the upper dead end position of the table drive 36. In this position, the stamping tool 34 is moved all the way upwardly into the die tool 18. When approaching the stretched position the movement reducing transmission ratio between the servomotors 41, 42 and the press table approaches infinite so that the stamping tool 34 can apply very high pressure forces to the workpiece.

Figure 4:
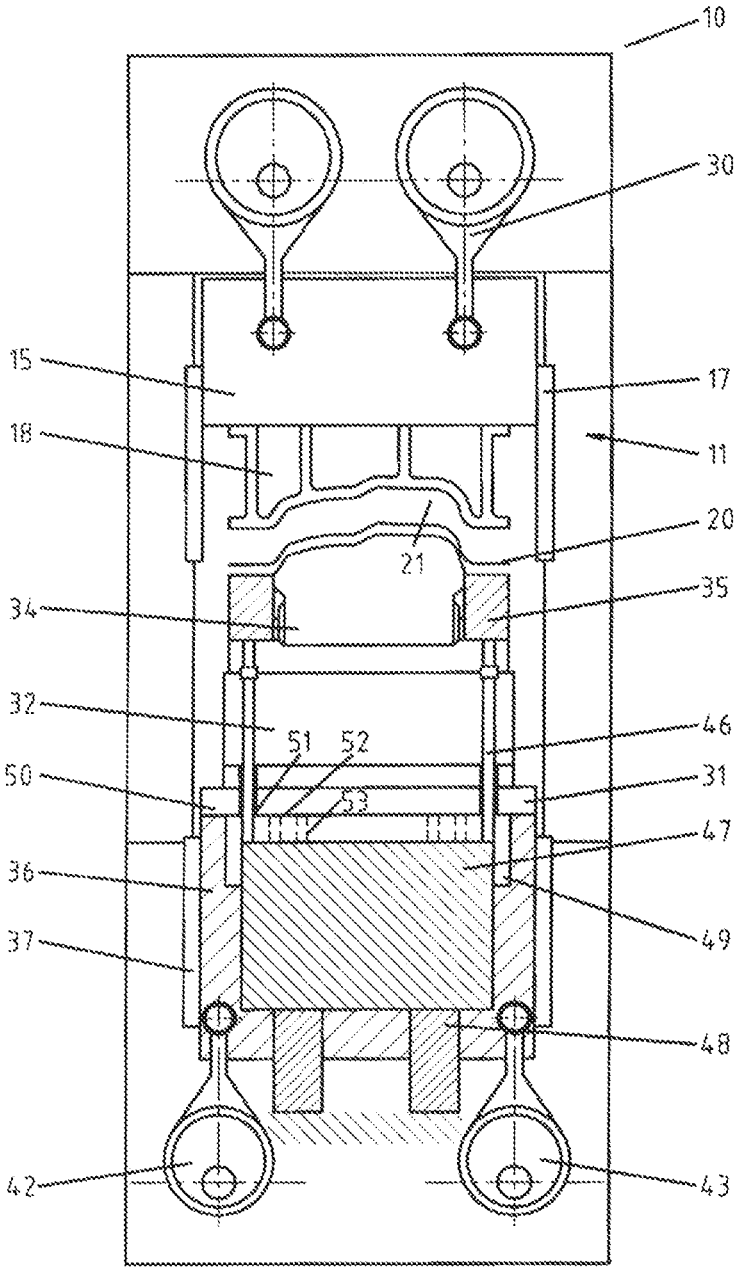
FIG. 4 the press according to FIG. 1 after completion of a drawing procedure with the tool again open.
Figure 5:
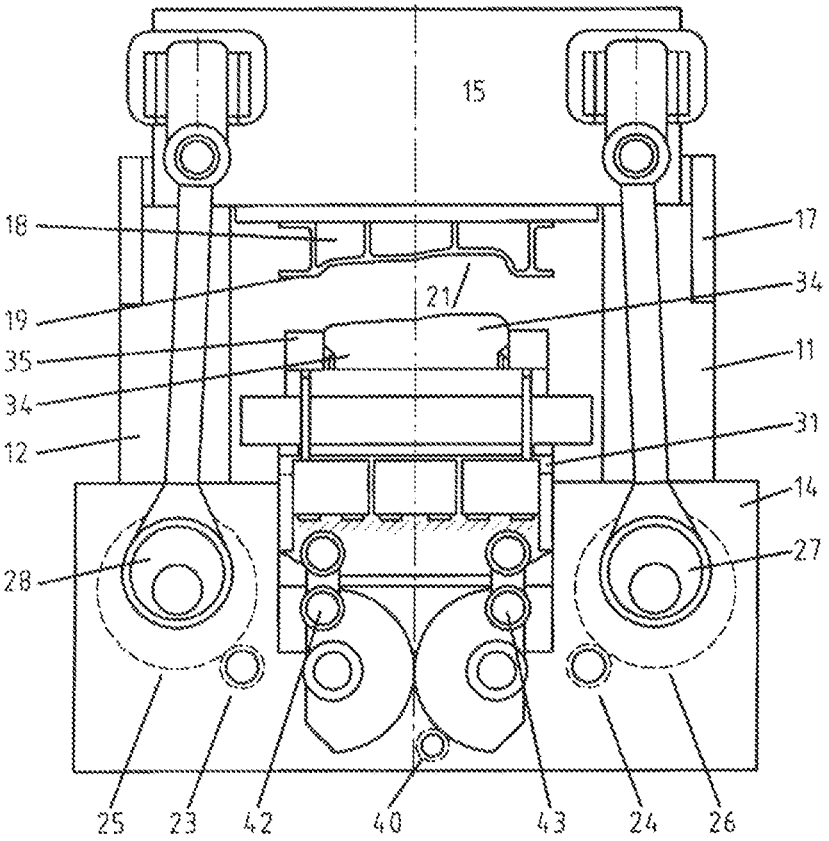
FIG. 5 a modified embodiment of the drawing press in a schematic representation.

Following this procedure the tool comprising the die tool and the stamping tool is again opened by retracting the plunger 15 upwardly and the press table downwardly while the metal sheet holder 35 remains in position. FIG. 4 shows the plunger 15 already in its upper end position while the stamping tool 34 is shown still in its actuated position. It is moved by a corresponding rotation of the eccentrics 42, 43 down whereupon the workpiece is disposed only on the metal sheet holder 35 and can be moved out of the drawing press 10 by a workpiece transport device, for example, a suction holder or similar.

The drawing press 10 described above provides a concept which is suitable for the utilization of drawing tools which, so far, have been used in connection with presses with drawing cushions arranged at the bottom. To this end, the press table 31 includes a group 50 of openings 51, 52, 53 through which the support elements 46 can selectively be inserted. As a result, tools of different sizes can be used whose metal sheet holders 35 extend over distance spaces of different size. This results in a geometrically variable force introduction for the metal sheet holder 35. It also provides for an increased free space area or, respectively comfort zone during tool removal.

The press concept disclosed herein permits numerous variations. The plunger 15 may be moved by the drive 25, 26, for example, by pulling if the servomotors 23, 24 are arranged on the base 14.

It is also possible that the drive for the press table 31 in this and all other embodiments is achieved via a single servomotor 40 if the gears of the eccentrics 42, 43 are in engagement with one another or the eccentrics are interconnected otherwise by suitable transmission means. Furthermore, the eccentrics 42, 43 may be reduced to segment wheels with gear structures provided only on a part of the circumference. For reducing costs this measure may also be applied to the gear structures of the eccentrics 27, 28.

Figure 6:
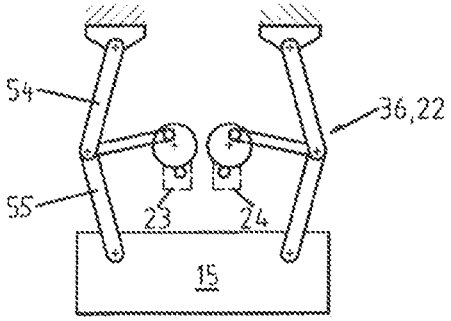
FIG. 6 a modified drive which may be used as plunger drive or alternatively also as table drive in connection with the drawing press according to the invention.

FIG. 6 shows furthermore a drive arrangement which may selectively also be used in connection with the plunger drive 22 as well as the table drive 36. Also this drive has a rest position when its links 54, 55 are in a stretched position. In this stretched position a rotational movement of the driving servomotors 23, 24 (or respectively 40, 41) causes no, or only a very small, linear displacement of the member connected thereto, that is the plunger 15. Forces applied to the plunger in this way are supported by the links 54, 55 in a straight line on the press frame 11 without applying a load to the servomotors.

Figure 7:
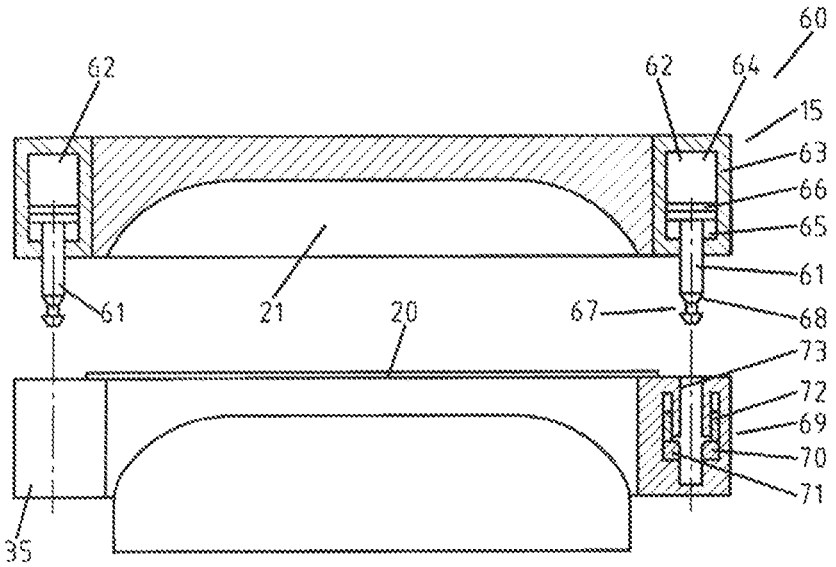
FIG. 7 a clamping arrangement of an alternative exemplary embodiment of the drawing press in a schematic representation.

In a further embodiment of the drawing press 10 as shown in FIG. 7 a clamping arrangement 60 is provided for clamping the metal sheet holder 35 into engagement with the upper plunger 15. The clamping arrangement 60 comprises several clamping units which are preferably distributed along the annular metal sheet holder 35.

The clamping unit 60 includes a pull element in the form of a clamping bolt 61 which is held by the plunger 15 and is supported so as to be movable at least slightly toward and away from the metals sheet holder. The minimal stroke to be performed by the clamping bolt 61 corresponds to the stroke which is needed for clamping down the metal sheet after it has been deposited. This stroke may be very small that is a few millimeters or fractions of a millimeter. Preferably, however, the stroke is essentially greater, specifically so large that the clamping bolt 61 can essentially by pulled completely into the plunger 15.

The clamping bolt 61 is provided with a force generating arrangement 62, which in this case, is for example, in the form of a hydraulic drive arrangement. It includes a hydraulic cylinder 63 with two working chambers 64, 65 which are separated from each other by a piston 66. The clamping bolt 61 forms, for example, the piston rod of the piston 66. This piston rod projects from the hydraulic cylinder 63 through a sealed opening.

At its lower end, the clamping bolt 61 is provided with locking means 67, for example, a locking groove 68 in the form of an annular groove. Preferably, the locking groove 68 is delimited at the side thereof facing the force generating arrangement 62 by a conical flank and at the opposite side by a planar flank.

The clamping arrangement 60 further includes a clamping bolt locking arrangement 69 provided with at least one, preferably several radially movable locking bars 70, 71. The locking bars are actuated by a hydraulic or another type of activator 72, for example, in the form of an annular piston which is arranged in an annular chamber coaxially with a bore 73 which accommodates the clamping bolt 61. The annular piston actuates the locking bars 70, 71 by way of a wedge drive whereby the locking bars can be actuated radially in a controlled manner.

The clamping bolt 61 can move into the bore 73 or out of the bore upon closing or, respectively opening the tool. However, it may also have a length of such a size that it always slides in the bore 73 without ever leaving the bore. Also, clamping arrangements with long bolts and clamping arrangements with short bolts may be intermixed wherein the clamping arrangements with short clamping bolts 61 which move out of their bore are arranged where otherwise, they would impede the movement of the workpiece into and out of the press.

In the locked state, the locking arrangement 69 provides for a force and/or form locking connections with the clamping bolt 61 of the plunger. The locking bars 70, 71 extend into the locking groove 68 of the respective clamping bolt 61. By means of the force generating arrangement 62, the metal sheet retaining force between the metal sheet holder 35 and the plunger 15 can then be set in an energy saving manner.

Figure 8:
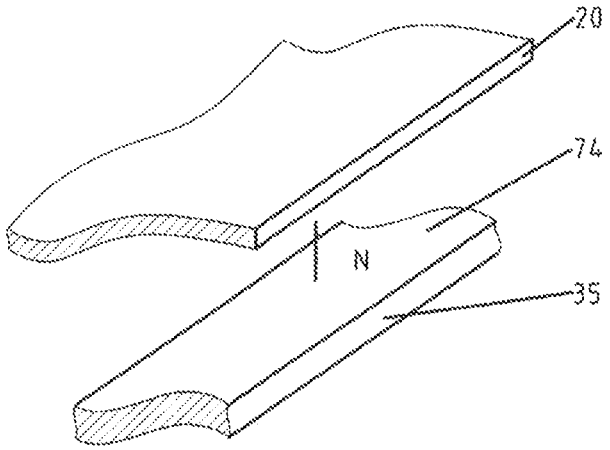
FIG. 8 a schematic perspective representation of a metal sheet holder clamping area of the drawing press; and, FIG. 9 a schematic representation of another exemplary embodiment of the drawing press in a block diagram-like form.

In order to achieve an energy-saving clamping of the metal sheet 20 in connection with high-strength metal sheets and to prevent unintended tearing of the metal sheet 20, the metal sheet holder clamping surface 74 facing the rim 19 provided for engagement with the metal sheet 20 is planar (see FIG. 8). That means that the metal sheet clamping surface 74 has no projections or depressions, in particular, no clamping strips which would cause local deformations of the metal sheet 20 during clamping. The surface normal N on the metal sheet clamping surface 74 is at any point oriented normal to the respective surface of the metal sheet 20 and to the rim 19.

Figure 9:
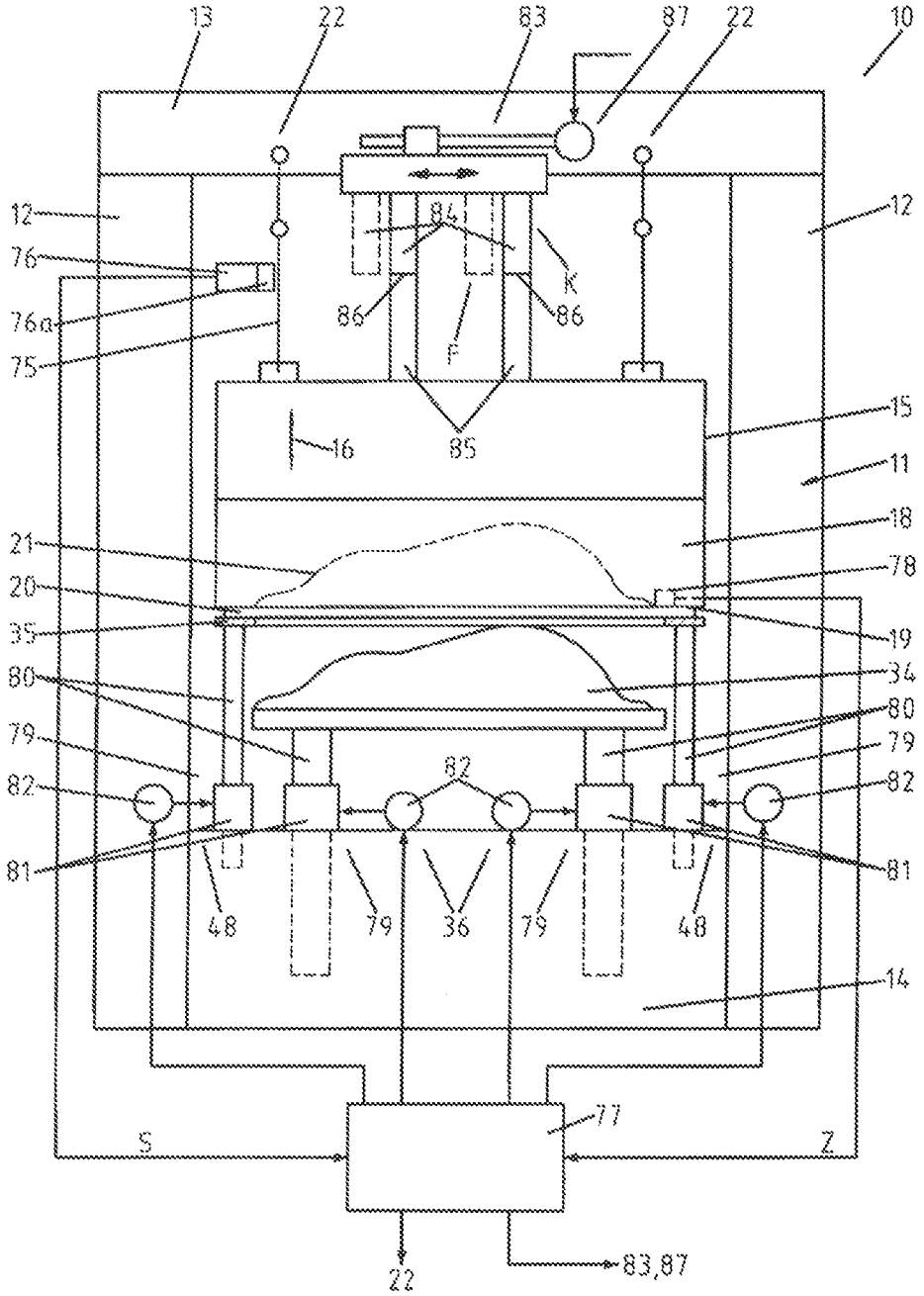

In the exemplary embodiment of the drawing press 10, as shown in FIG. 9, the plunger drive 22 is formed by an elbow lever drive. At least one of the levers 75 of the elbow lever drive or an elbow joint may be assigned a position sensor 76. The position sensor 76 detects whether the elbow lever arrangement of which the lever 75 is part has assumed its stretched position that is its blocking positioning which it is shown in FIG. 9. The position sensor 76 is in communication with a control unit 77 in order to transmit thereto the position sensor signal S.

The position sensor 76 may serve at the same time also as a stop and/or clamping element 76*a* for the lever 75 or be provided with a stop and/or damping element 76*a*. In this way, the blocking position can be accurately established.

In this embodiment, the plunger drive operates preferably in a pivot that is a back and forth mode, wherein the servomotors of the plunger drive 22 reverse their direction of rotation at the upper and the lower end position of the plunger 15.

In a variant of the exemplary embodiment as shown in FIG. 9, the plunger drive 22 may also be in the form of an eccentric drive as it is shown in previous exemplary embodiments.

The die tool may optionally be provided with a permeability sensor 78 which generates a tension signal Z and transmit it to the control unit 77. The tension signal Z indicates the tension in the metal sheet 20 during its deformation. To this end, the permeability sensor 78 detects the permeability of the metal sheet 20 which changes as a result of the tension. The tension signal Z may be used for optimizing the retaining force of the metal sheet holder 35 and/or the deformation force between the stamping tool 34 and the metal sheet 20.

In the exemplary embodiment of FIG. 9, the table drive 36 is formed by one or several spindle drives 79. Each spindle drive 79 comprises a spindle 80, a spindle nut 81, and an electric motor 82 driving, for example, the spindle nut 81. Alternatively, the electric motor 82 could also drive the spindle 80. Other than shown in the schematic representation of FIG. 9, the electric motor 82 is preferably a hollow shaft motor with an internal motor, which surrounds the spindle nut 81 concentrically. Such spindle motors 79 are provided also, for example, as adjustment apparatus 48 for adjusting the metal sheet holding force of the metal sheet holder 35.

The spindle drive 79, or respectively, the electric motor 82 of the spindle drives 79 are controlled by the control unit 77.

The transmission ratio between the spindle nut 81 and the spindle 80 can, in particular for the adjustment apparatus 48, be so selected that the spindle drive is self-locking. In this case, the respective electric, motor 82 needs to be energized only when the metal sheet retaining force needs to be changed or adjusted. For maintaining a set metal sheet retaining force energization of the electric motor is not necessary.

The control unit controls the plunger drive 22 and, in the shown exemplary embodiment, also a blocking arrangement 83. The blocking arrangement 83 is arranged between the press frame 11, for example, the head 13 and the plunger 15. Independently of whether the plunger drive 22 is exactly in its blocking position or not, via the blocking arrangement 83 a rigid connection between the plunger 15 and the press frame 11 can be established. This rigid coupling prevents a movement of the plunger 15 in the direction of movement 16 as a result of the forces acting on the plunger 15 by the metal sheet holder 35 or the stamping tool 34.

By the control unit 77, the blocking arrangement 83 can be switched between a coupling position K (full line in FIG. 9) and release position F (dotted line in FIG. 9). To this end, the blocking arrangement 83 comprises blocking elements 84 which, in their coupling position K, cooperate with counter elements 85 on the plunger 15. In the coupling position K, the blocking elements 84 are in alignment with respective counter elements 85 in the direction of movement 16 and abut the respective front faces 86. The plunger 15 is therefore supported by the press frame 11 and, as shown in the figure, on the head 13 via the counter elements 85 and the blocking elements 84. In the coupling position K consequently a very rigid coupling between the plunger 15 and the press frame 11 is ensured during the deformation of the metal sheet 20. No counter support force needs to be applied by means of the plunger drive 22 which improves the energy efficiency of the press.

In the release position F, the blocking elements 84 are displaced transverse to the direction of movement 16 relative to the counter elements 85 so that the plunger 15 can be moved by the plunger drive 22 from its lower end position in the direction of movement 16 upwardly.

For moving the blocking elements 84 between the coupling position K and the release position F the blocking arrangement 83 includes a linear drive 87 which is controlled by the control unit 77. The linear drive 87 may, for example, be a spindle drive which is operated by an electric motor. Also other linear drives may be used.

Different from the representation in FIG. 9, the displaceable blocking elements 84 may also be arranged at the plunger 15. Then the counter elements 85 are arranged on the press frame 11 and preferably on the head 13.

In the above described embodiments, the metal sheet holder 35 may also be mounted rigidly to the press frame 11. The adjustment apparatus 48 may then be assigned to a mini section of the plunger 15 which co-operates with the metal sheet holder 35 for engaging the metal sheet and which is movable in the direction of movement by the adjustment apparatus 48.

The drawing press 10 according to the invention includes a support structure 47 for supporting a metal sheet holder 35 which is part of a tool and which can be supported by the press frame 11 via the support structure 47. A plunger 15 with a die tool 18 is provided so as to be movable via a plunger drive into a blocking position where it is in engagement with the metal sheet holder 35. The blocking position is achieved, for example, by a plunger drive 22 which in this blocking position does not transmit any movement from the drive to the drive motor 23 and/or 34. This is, for example, achieved by an eccentric drive 25, 26 when it is in its stretched position. For performing the actual drawing stroke, the stamping tool 34 is supported so as to be movable vertically. The carriage 32 associated therewith is raised or lowered by the press table 31 by means of a table drive 36. For driving the table 31, a servo drive 36 is provided again with a nonlinear drive arrangement such as an eccentric drive.

LISTING OF REFERENCE NUMERALS

10 drawing press
11 press frame
12 post
13 head
14 base
15 plunger
16 direction of movement
17 linear guide structure
18 die tool
19 rim
20 flat metal sheet
21 hollow space
22 plunger drive
23, 24 servomotors
25, 26 drives
27, 28 eccentric
29, 30 connecting rod
31 press table
32 carriage
33 tool support
34 stamping tool
35 metal sheet holder
36 table drive
37 guide arrangement
38, 39 drives
40, 41 servomotor
42, 43 eccentric
44, 45 connecting rod
46 support bolts
47 support structure
48 adjustment apparatus
49 linear guide arrangement
50 group
51, 52, 53 openings
54, 55 links
60 clamping arrangement
61 clamping bolt
62 force generating arrangement
63 hydraulic cylinder
64, 65 working chamber
66 piston
67 locking means
68 locking groove
69 locking arrangement
70, 71 locking bars
72 actuator
73 bore
74 metal sheet holder clamping surface
75 lever
76 position sensor

76*a* stop and/or clamping element
77 control unit
78 permeability sensor
79 spindle drive
80 spindle
81 spindle nut
82 electric motor
83 blocking arrangement
84 blocking element
85 counter element
86 front face
87 linear drive
F release position
K coupling position
N surface normal
S position signal
Z tension signal

What is claimed is:

1. Drawing press (10), including a press frame (11);

a plunger (15) which is supported in the press frame (11), so as to be movable by means of a plunger drive (22) in a direction of movement (16);

the press frame (11) in operative supportive arrangement with a support structure (47), the support structure (47) in operative supportive arrangement with a plurality of support elements (46), the plurality of support elements (46) in operative supportive arrangement with a metal sheet holder (35);

a table drive (36) which is connected to a table (31) for driving the table in the movement direction (16);

the plunger drive (22) includes a first servomotor (23, 24) in operative arrangement with a first drive (25, 26) which is an eccentric drive or an elbow lever drive comprising a plurality of first drive elements in operative connection with the plunger (15) and/or the table drive (36) includes a second servomotor (40, 41) in operative arrangement with a second drive (38, 39) which is an eccentric drive or an elbow lever drive comprising a plurality of second drive elements in operative connection with the table (31);

a stamping tool (34) is supported on the table (31);

the first drive (25, 26) of the plunger drive (22) and/or the second drive (38, 39) of the table drive (36) is configured to have a stretched position of said respective first drive elements and/or said second drive elements in a respective blocking or rest position of the plunger drive (22) and/or the table drive (36) in which no movement transfer from a respective drive output to the first servomotor (23, 24) and/or the second servomotor (40, 41) connected to a respective drive input occurs and the first servomotor (23, 24) and/or the second servomotor (40, 41) is substantially load free;

the table drive (36) is adapted to provide a deformation stroke of the table (31) and the stamping tool (34), the deformation stroke is required for deforming a metal sheet while the plunger drive (22) is in the blocking position;

the plunger drive (22) and/or the table drive (36) includes at least one additional electric motor (82) which is operable reversibly; and, a blocking arrangement (83) is provided which is switchable between a release position (F) and a coupling position (K) and which, in its coupling position (K) provides for a rigid coupling between the plunger (15) and the press frame (11).

2. Drawing press according to claim 1, characterized by a die tool (18) is mounted to the plunger (15).

3. Drawing press according to claim 1, characterized by the table (31) further includes passages (51, 52, 53) therethrough, the support elements (46) are provided which extend through at least some of the passages (51, 52, 53) and via which the metal sheet holder (35) is supported on the support structure (47).

4. Drawing press according to claim 1, characterized by the support structure (47) is firmly supported on the frame (11) so as to be stationary.

5. Drawing press according to claim 1, characterized by the support structure (47) and the plunger (15) being both supported by the press frame (11) are arranged resiliently with respect to each other.

6. Drawing press according to claim 1, characterized by the support structure (47) is provided with an adjustment apparatus (48) for controlling a metal sheet retaining force.

7. Drawing press according to claim 6, characterized by the adjustment apparatus (48) includes at least one spindle drive (79).

8. Drawing press according to claim 7, characterized by the table drive (36) and/or the plunger drive (22) and/or the adjustment apparatus (48) are controlled separately by a control unit (77).

9. Drawing press according to claim 1, characterized by when the first drive (25, 26) is an eccentric drive the first drive elements include a first eccentric (27, 28) and a first connecting rod (29, 30) and/or when the second drive (38, 39) is an eccentric drive the second drive elements include a second eccentric (42, 43) and a second connecting rod (44, 45).

10. Drawing press according to claim 1, wherein when the first drive (25, 26) and/or the second drive (38, 39) is an elbow lever drive the respective first drive elements and/or the second drive elements each include a first link (54) and a second link (55).

11. Drawing press according to claim 10, characterized by the elbow lever drive includes a lever (75), a position sensor (76) is operatively arranged to detect if the elbow lever drive has assumed the stretched position and for transmitting a position sensor signal S to a control unit (77).

12. Drawing press according to claim 1, characterized by the table drive (36) includes an eccentric drive whose eccentric rotates during a press stroke by less than 90 degrees.

13. Drawing press according to claim 1, characterized by the table drive (36) and/or the plunger drive (22) include at least one spindle drive (79).

14. Drawing press according to claim 1, characterized by a clamping arrangement (60) is provided for establishing a connection between the plunger (15) and the metal sheet holder (35).

15. Drawing press according to claim 1, wherein the blocking arrangement (83) comprises blocking elements (84) which in the coupling position (K) cooperate with respective aligned counter elements (85) on the plunger (15) for the rigid coupling between the plunger (15) and the press frame (11) and in the release position (F) the blocking elements are displaceable transverse to the direction of movement (16) relative to the counter elements (85) for permitting the plunger drive (22) to move from a lower end position in the direction of movement (16) upwardly.

16. Drawing press according to claim 15, further including a linear drive (87) controlled by a control unit (77), the linear drive (87) in operative arrangement with the blocking elements (84) for moving the blocking elements (84) between the coupling position (K) and the release position (F).

17. Drawing press according to claim 16, wherein the linear drive (87) is a spindle drive.

* * * * *